United States Patent [19]

Robinson, Jr. et al.

[11] 4,120,316

[45] Oct. 17, 1978

[54] FLOW CONTROL VALVE ASSEMBLY

[75] Inventors: Glen P. Robinson, Jr., Atlanta; Samuel V. Shelton, Stone Mountain, both of Ga.

[73] Assignee: Scientific-Atlanta, Inc., Atlanta, Ga.

[21] Appl. No.: 772,535

[22] Filed: Feb. 28, 1977

Related U.S. Application Data

[60] Division of Ser. No. 565,629, Apr. 7, 1975, Pat. No. 4,009,587, which is a continuation-in-part of Ser. No. 550,413, Feb. 18, 1975, Pat. No. 3,988,901.

[51] Int. Cl.[2] ..... G05D 7/01

[52] U.S. Cl. ..... 137/498; 91/218; 91/268; 91/273; 137/496; 137/516.25

[58] Field of Search ..... 137/496, 498, 501, 155, 137/516.25; 91/218, 246, 268, 273

[56] References Cited

U.S. PATENT DOCUMENTS

| | | | |
|---|---|---|---|
| 352,594 | 11/1886 | Wilder | 137/501 X |
| 569,781 | 10/1896 | Brown | 137/501 |
| 2,696,831 | 12/1954 | Malick | 137/501 X |
| 2,807,144 | 9/1957 | St. Clair | 137/501 X |
| 3,017,871 | 1/1962 | McKiney | 137/516.25 X |
| 3,055,391 | 9/1962 | Shuk | 137/516.25 |
| 3,177,892 | 4/1965 | Grandstaff | 137/501 |
| 3,326,233 | 6/1967 | Perruzzi | 137/516.25 X |

FOREIGN PATENT DOCUMENTS

| | | | |
|---|---|---|---|
| 924,653 | 3/1947 | France | 137/501 |
| 26,615 of | 1912 | United Kingdom | 137/501 |
| 479,090 | 7/1975 | U.S.S.R. | 137/501 |

*Primary Examiner*—Robert G. Nilson
*Attorney, Agent, or Firm*—B. J. Powell

[57] ABSTRACT

A flow control valve assembly for controlling the flow of a working fluid which has a housing that defines a valve chamber therein, an inlet port to the valve chamber and an outlet port from the valve chamber, a valve body which is movably carried in the chamber between a closed position that blocks the outlet port from communication with the inlet port and an open position so that the inlet port is in communication with the outlet port to allow the working fluid to be forced through the valve chamber, and a valve control means responsive to the velocity of the working fluid flowing through the valve chamber or responsive to the pressure differential across the valve body to operate the valve assembly by moving the valve body between the open position and the closed position.

5 Claims, 6 Drawing Figures

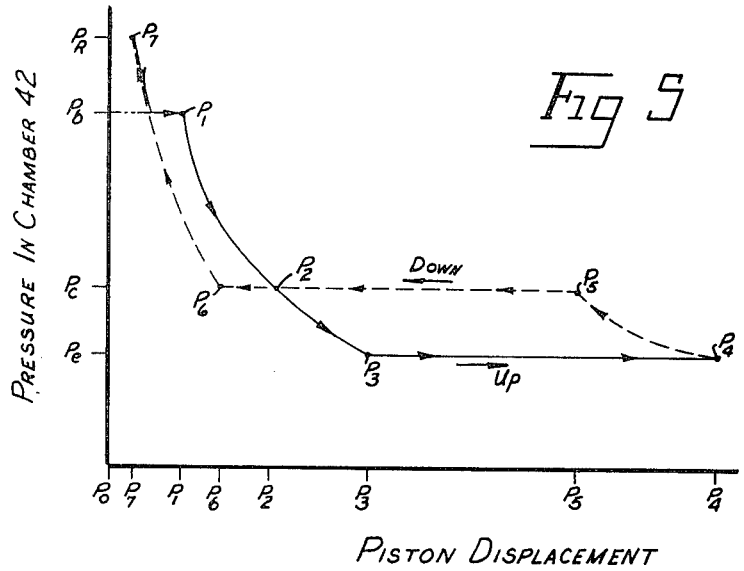
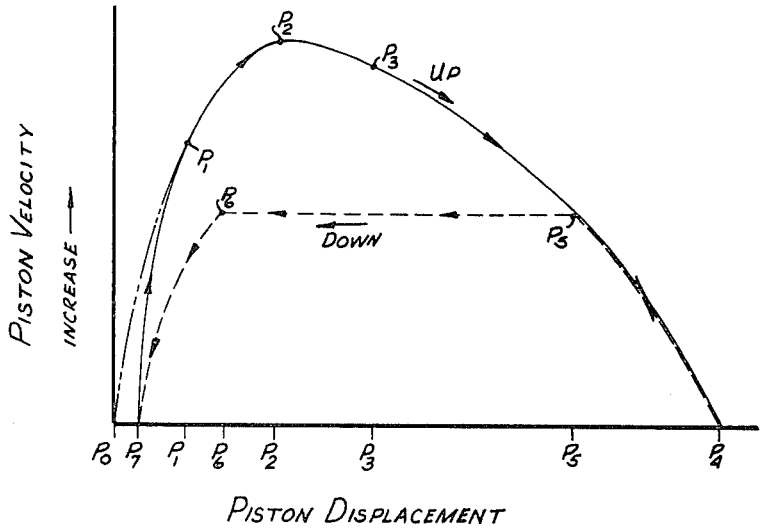
Fig 6

FLOW CONTROL VALVE ASSEMBLY

CROSS-REFERENCE TO RELATED APPLICATIONS

This application is a division of our copending application Ser. No. 565,629, filed Apr. 7, 1975 for "Combined Loop Free-Piston Heat Pump", now U.S. Pat. No. 4,009,587, which is in turn a continuation-in-part of our application Ser. No. 550,413, filed Feb. 18, 1975, now U.S. Pat. No. 3,988,901.

BACKGROUND OF THE INVENTION

Because of lack of fuel for combustion processes, alternatives are being sought for electrically driven heat pump systems or heat driven heat pump systems using combustion processes to supply the necessary heat to drive the system. One alternative that has been suggested is to use solar energy to supply the necessary heat to drive a heat driven heat pump system rather than a combustion process. Two general types of heat driven, heat pump systems are available. The first type is an absorption system which uses heat to boil a refrigerant out of a carrier liquid in a boiler generator, passes the refrigerant through a condenser and an evaporator, and then recombines the refrigerant with the carrier liquid for recycling in an absorber. The second type is a dual loop system that has a power loop in which the power loop working fluid is heated and used to power an expansion-compression device. The heat pump loop of such systems is connected to the compression side of the expansion-compression device and operates on the vapor compression cycle.

With an absorption system, the minimum temperature required to operate such a system is relatively high. Presently available solar energy collection systems, on the other hand, are able to obtain this relatively high operating temperature required for an absorption system for only a short period of time during a twenty-four hour period under the best of conditions and in many instances not at all. This has required the use of a large collector associated with a thermal storage system to collect and store the high temperature heat energy when available for later use or a combustion process to supplement the heat obtained from solar energy for most of the required operating time of the absorption system thus making it uneconomical to use solar energy to drive an absorption system especially when the initial installation cost is considered.

One heat driven dual loop system that has been suggested uses a linear motion free-piston expansion-compression device such as that disclosed in U.S. Pat. Nos. 2,637,981 and 3,861,166. These free-piston expansion-compression devices have been able to operate effectively and efficiently only within very limited temperature ranges of heat input and in order to obtain reasonable efficiencies have also required relatively high minimum temperatures to drive the system. Because the heat output capability from presently available solar energy collection systems always varies widely over a twenty-four hour period and also because these solar energy collection systems are able to collect heat at the required relatively high operating temperatures required for the dual loop system for only a short period of time during a twenty-four hour period under the best of conditions, it has been necessary to use a large collector associated with a thermal storage system to collect and store the high temperature heat energy when available for later use or a combustion process to supplement the heat obtained from solar energy for most of the required operating time of the system. Thus, like the absorption system, solar energy has been unable to economically drive a dual loop heat pump system with an expansion-compression device.

SUMMARY OF THE INVENTION

These and other problems and disadvantages associated with the prior art are overcome by the invention disclosed herein by providing a heat driven, dual loop heat pump system with an expansion-compression device which can be operated on relatively low temperatures and pressures in the power loop working fluid. Such temperatures and pressures are within the capability of a solar energy collection system to heat the working fluid in the power loop. Further, the system is normally operated over wide temperature ranges without irreversible throttling processes thereby increasing its operational efficiency. Also, the invention has the capability of operating over a wide temperature and pressure range in the working fluid of the power loop without irreversible throttling processes maximizing the efficiency over the entire system range, especially important when using solar energy to drive same. The kinetic energy temperarily stored in the linearly moving mass of the free-piston in the expansion-compression device is transmitted back into the working fluid of the system so that it is usually recovered and further prevents throttling losses. Further, the invention is simple in construction with a minimum of moving parts in the expansion-compression device and requires very little maintenance.

The apparatus of the system comprises an expansion-compression device with one or more free-pistons slidably carried therein. Each free piston is selectively connected to the power loop working fluid which operates according to the Rankine cycle and to the refrigeration or heat pump loop working fluid operated on a vapor compression cycle through an appropriate valve and control system. The valve and control system selectively associated the working fluid of the power loop with the free piston in the expansion-compression device to cause the power loop working fluid to drive the free piston linearly and induce linear kinetic energy in the free piston, to then associate the working fluid of the heat pump loop with the free piston while the kinetic energy is maintained therein so that the linear kinetic energy temporarily stored in the moving piston is transferred back into the working fluid of the system. The power loop includes a boiler which receives heat from a heat source such as a solar energy collector and transfers this heat to the power loop working fluid to drive the system, and the refrigeration or heat pump loop system includes an evaporator which receives the refrigeration or heat pump loop working fluid and transfers heat to the working fluid in the heat pump loop from an outside medium. The power loop and the refrigeration or heat pump loop share a condenser which receives both the power loop working fluid and the refrigeration or heat pump loop working fluid therein to cool the system working fluid by transferring heat therefrom to an outside medium.

The method of the invention is directed to the operation of a dual loop, heat pump system with an expansion-compression device having a linearly movable piston therein, a Rankine cycle power loop driving the expansion-compression device and a vapor compression heat pump loop driven by the expansion-compression device which includes the steps of selectively associating the working fluid of the power loop with the linearly movable piston of the expansion-compression device to cause the power loop working fluid to drive the free piston linearly and induce linear kinetic energy in the free piston and selectively associating the working fluid of the system with the free piston while the linear kinetic energy is stored therein to cause the kinetic energy of the free piston to be transferred back into the working fluid of the system as work of compression.

These and other features and advantages of the invention will become more clearly understood upon consideration of the following specification and accompanying drawings wherein like characters of reference designate corresponding parts throughout the several views and in which:

BRIEF DESCRIPTION OF THE DRAWINGS

FIG. 5 is a graph illustrating the pressure in the working subchamber of that embodiment of the invention shown in FIG. 1 versus piston displacement; and, FIG. 6 is a graph illustrating the piston velocity of that embodiment of the invention shown in FIG. 1 versus piston displacement.

These figures and the following detailed description disclose specific embodiments of the invention, however, it is to be understood that the inventive concept is not limited thereto since it may be embodied in other forms.

BRIEF DESCRIPTION OF ILLUSTRATIVE EMBODIMENTS

This application is a division of Ser. No. 565,629 and application Ser. No. 565,629 is incorporated herein by reference. For sake of simplicity, those portions of application Ser. No. 565,629 not necessary for the understanding of the invention of this application are not repeated herein.

Figure 1:
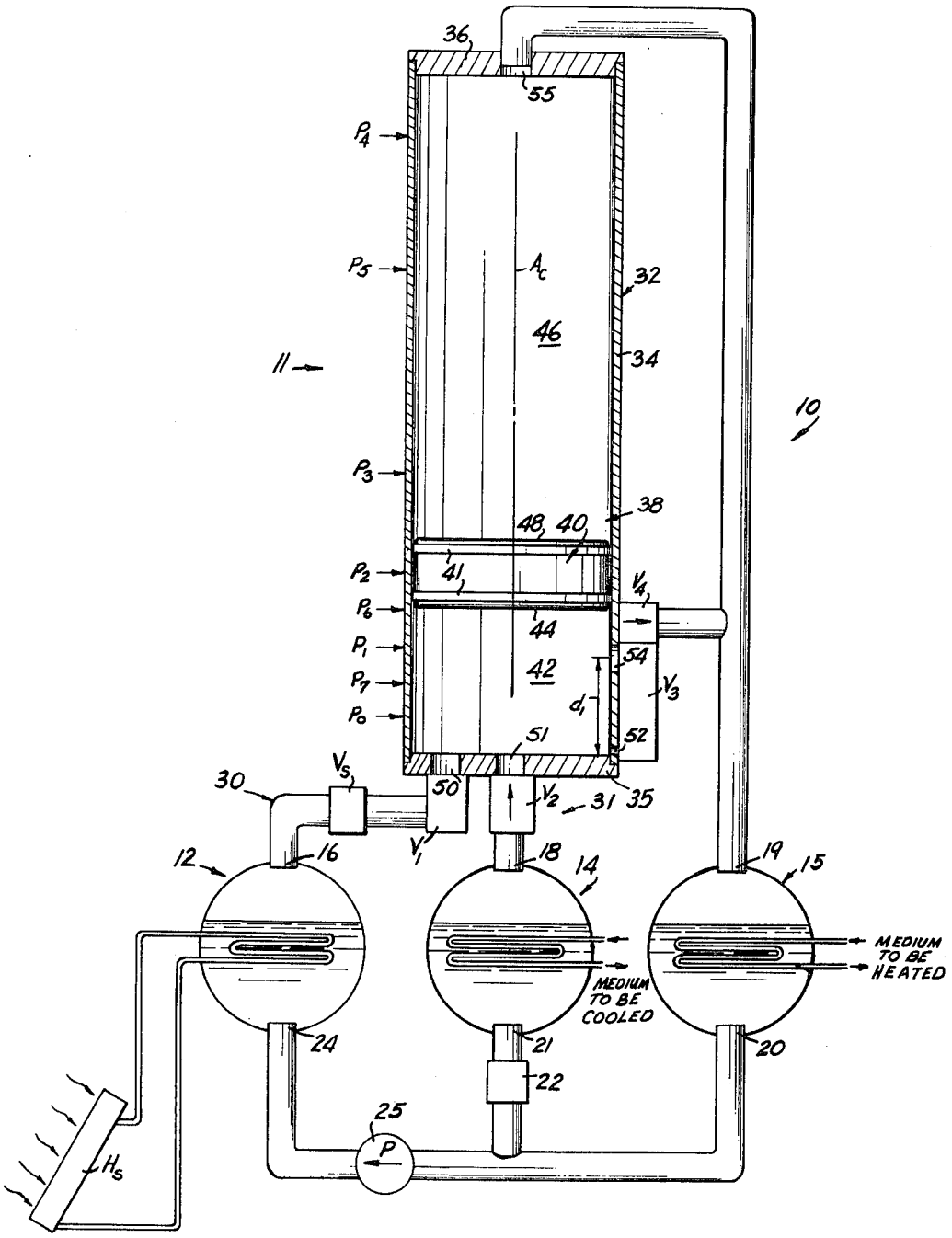
FIG. 1 is a schematic view of one embodiment of the invention showing the expansion-compression device in cross-section.

Referring to FIG. 1, it will be seen that the heat pump system 10 includes an expansion-compression device 11, a boiler 12, an evaporator 14 and a condenser 15. The outlet 16 of the boiler 12 is connected to the expansion-compression device 11 to drive same, the outlet 18 of the evaporator 14 is also connected to the expansion-compression device 11 to supply working fluid thereto which is to be compressed and the inlet 19 of the condenser 15 is connected to the expansion-compression device 11 to receive the compressed fluid therefrom. The outlet 20 of the condenser 15 is connected to the inlet 21 of the evaporator 14 through a conventional expansion valve 22 and the outlet 20 of the condenser 15 is also connected to the inlet 24 of the boiler 12 through a liquid pump 25. Thus, it will be seen that the system 10 uses a single working fluid and is a dual loop system with the boiler 12, expansion-compression device 11, and condenser 15 forming the power loop while the evaporator 14, expansion-compression device 11 and condenser 15 forming the heat pump or refrigeration loop. For sake of simplicity, the refrigeration or heat pump loop will be referred to hereinafter as a heat pump loop, it being understood that this terminology also includes the refrigeration loop since the only difference between a refrigeration loop and a heat pump loop is that the medium on which the temperature is desired to be controlled is cooled by the evaporator in a refrigeration loop and heated by the condenser in a heat pump loop. The Rankine cycle power loop has been designated generally 30 in FIG. 1 while the vapor compression cycle heat pump loop has been designated generally 31 in FIG. 1. The boiler 12 is in a heat exchange relation with a heat source $H_S$ such as a solar energy collector, the evaporator 14 is in a heat exchange relation with a medium which is to be cooled and the condenser 15 is in a heat exchange relation with the medium to be heated as is known in the heat pump art.

The expansion-compression device 11 is a free piston device which is driven by high pressure working fluid from the boiler 12 and compresses the system working fluid to discharge same to the condenser 15. The device 11 includes an elongate cylinder 32 with a central axis $A_C$. The cylinder 32 has an annular cylindrical side wall 34 closed at its lower end by end wall 35 and closed at its upper end by an end wall 36. A free piston 40 is slidably carried in the chamber 38 defined by the side wall 34 and the end walls 35 and 36 in sealing engagement with the side wall 34 through sealing rings 41 about the periphery of the free piston 40. It will thus be seen that the free piston 40 divides the chamber 38 into a working subchamber 42 between the lower face 44 of the piston 40 and the end wall 35 and a back-up subchamber 46 between the upper face 48 of the piston 40 and the end wall 36. The piston 40 is slidably movable within the cylinder 32 along the central axis $A_C$ so that both the working subchamber 42 and the back-up subchamber 46 vary in size as the piston moves linearly along the axis $A_C$. The piston 40 also has a prescribed weight.

The end wall 35 defines a boiler inlet port 50 therethrough which is connected to the outlet 16 of the boiler 12 through boiler valve $V_1$, and an evaporator inlet port 51 which is connected to the outlet 18 of the evaporator 14 through the evaporator check valve $V_2$ that allows fluid to only flow from evaporator 14 into subchamber 42. The side wall 34 defines an actuation port 52 therethrough at the juncture of the side wall 34 with the end wall 35 and a condenser outlet port 54 therethrough spaced a prescribed distance $d_1$ inboard of the port 52. The port 54 is connected to the inlet 19 of the condenser 15 through a condenser control valve $V_3$ and a condenser check valve $V_4$ while the actuation port 52 is connected to the condenser control valve $V_3$ to control same. The end wall 36 defines a back-up port 55 therethrough which is in direct connection with the inlet 19 to the condenser 15.

The valves $V_1$–$V_4$ control the operation of the system. With mid point of the piston 40 at its lowermost position $P_0$ shown in FIG. 1, the valves $V_2$–$V_4$ are closed and the boiler valve $V_1$ opens to introduce the high pressure working fluid from the boiler 12 into the working subchamber 42 to drive piston 40 toward the back-up subchamber 46 in an up stroke and accelerate the piston. The positions indicated are all taken from the mid point of piston 40. When the piston 40 reaches a predetermined velocity, at say position $P_1$, the boiler valve $V_1$ closes, however, the working fluid at boiler pressure in the working subchamber 42 is higher than the condenser pressure in the back-up subchamber 46 so that the working fluid at the boiler pressure in the working subchamber 42 is allowed to expand and continue to accelerate the piston 40 toward the back-up subchamber 46. When the working fluid in the working subchamber 42 has expanded sufficiently, say when the piston 40 reaches position $P_2$, the pressure of the working fluid in the subchamber 42 reaches condenser pressure so that no further energy is added to the piston 40 by the working fluid in the subchamber 42. The piston 40, however, continues to move past position $P_2$ due to the linear kinetic energy stored in the piston 40.

As the piston 40 continues to move upwardly along the axis $A_C$, in its up stroke, the pressure of the working fluid in the working subchamber 42 drops below the pressure of the working fluid in the back-up subchamber 46 so that the net force on the piston 40 reverses to a downward force causing the piston 40 to decelerate since the linear kinetic energy in the free piston 40 is being consumed as flow work of compression. When the piston 40 reaches a certain position, say position $P_3$, the working fluid in the subchamber 42 has expanded slightly below the pressure of the working fluid in the evaporator 18 and the evaporator check valve $V_2$ connecting the outlet 18 of the evaporator 14 to the working subchamber 42 opens to allow working fluid from the evaporator 14 to be drawn into the working subchamber 42. At some later position, say position $P_4$, the piston 40 will have lost all of its linear kinetic energy and come to rest at the end of the up stroke. Now, however, the pressure in the back-up subchamber 46, being at condenser pressure, is higher than the pressure in the working subchamber 42, being at evaporator pressure. This causes the motion of the piston 40 to reverse with the working fluid in the back-up subchamber 46 accelerating the piston 40 downwardly in its down stroke. This causes the evaporator check valve $V_2$ to close to trap the working fluid in the subchamber 42 and cause the piston 40 to compress the working fluid in the subchamber 42 as it accelerates downwardly along the axis $A_C$. When the piston reaches some position, say position $P_5$, on its return down stroke toward the working subchamber 42, the pressure of the working fluid in the subchamber 42 will have been compressed up to condenser pressure.

At this point, valves $V_3$ and $V_4$ connect the working subchamber 42 to the inlet 19 of the condenser 15 so that the working fluid in the working subchamber 42 is expelled into the condenser 15. It will also be noted that the net force on the piston 40 has reached zero at position $P_5$, however, the linear kinetic energy stored in the piston 40 as it is accelerated from position $P_4$ to position $P_5$ continues to move the piston 40 downwardly toward the subchamber 42. As the piston 40 covers condenser outlet port 54 at position $P_6$, the valve $V_3$ closes to prevent the working fluid in the subchamber 42 from being further discharged into the condenser 15 so that the working fluid in the subchamber 42 is allowed to rise to a pressure sufficient to completely decelerate the piston 40 by the time it reaches another position, say position $P_7$, to limit the down stroke of the piston 40. It will be noted, however, that the pressure in the working subchamber 42 is now well above the pressure in the back-up subchamber 46 so that the piston reverses its travel under this pressure and starts movement back toward the back-up subchamber 46 in its up stroke. When the pressure in the working subchamber 42 has dropped back to the pressure of the working fluid in the boiler 12, the boiler valve $V_1$ is again opened to accelerate the piston and the cycle repeated.

BOILER VALVE

Figure 2:
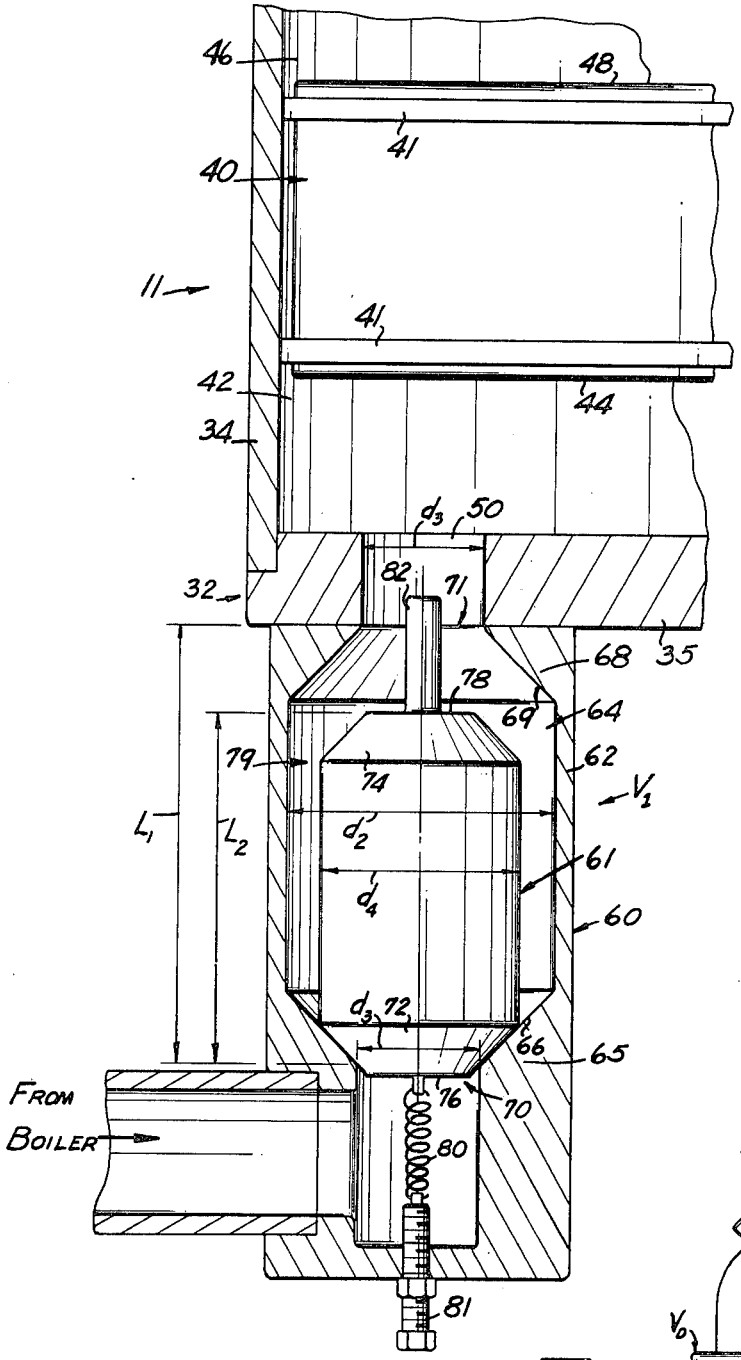
FIG. 2 is an enlarged cross-sectional view of one embodiment of the boiler valve of the invention.

Referring to FIG. 2, the construction of the boiler valve $V_1$ is illustrated in detail. The valve $V_1$ is designed to introduce the working fluid from the boiler 12 into the working subchamber 42 of the expansion-compression device 11 upon activation and to continue to introduce the working fluid from the boiler 12 into the subchamber 42 until the piston 12 has a predetermined linear kinetic energy induced therein. Because the velocity of the free piston 40 determines the linear kinetic energy induced therein and because the rate at which the volume of the working subchamber 42 is increasing is directly proportional to the velocity of the free piston 40, the velocity of the working fluid from the boiler 12 entering the subchamber 42 is an indication of the velocity of the piston 40. The velocity of the working fluid from the boiler 12 is thus used to close the boiler valve $V_1$ since this velocity is an indication of the velocity, and thus, the linear kinetic energy, of the piston 40.

The boiler valve $V_1$ includes a tubular housing 60 which mounts a valve body 61 therein for movement between an upward position blocking the flow of boiler fluid into the subchamber 42 to a lower position blocking the flow of the working fluid from the working subchamber 42 to the boiler. The housing 60 has a cylindrical side wall 62 defining a valve chamber 64 therein of diameter $d_2$ with a lower inwardly tapered section 65 forming a valve seat 66 on the inside thereof and an upper inwardly tapering section 68 forming a valve seat 69 on the inside thereof. The valve seat 66 defines an inlet opening 70 therethrough of diameter $d_3$ and the upper valve seat 69 also defines an outlet opening 71 therethrough of the diameter $d_3$.

The valve body 61 is cylindrical with a diameter $d_4$ less than the diameter $d_2$ and has an inwardly tapered seating surface 72 at the lower end thereof adapted to seat on the lower valve seat 66 in sealing relationship therewith when the body moves downwardly in housing 60. The upper end of the valve body 61 has also an inwardly tapering seating surface 74 adapted to engage the upper valve seat 69 in sealing engagement therewith when the body 61 moves upwardly in the housing 60. It will be noted that the valve chamber 64 has a length $L_1$ greater than the length $L_2$ between the lower face 76 of the body 61 and the upper face 78 of the body 61. The relationship between the diameters $d_2$ and $d_4$ is such that the cross-sectional area of the annular passage 79 between the body 61 and the side wall 62 is such that flow through this passage produces a pressure drop. It will also be noted that the inlet opening 70 is connected directly to the boiler 12 while the outlet opening 71 is connected directly to the working subchamber 42 through the port 50. The valve body 61 is constantly urged toward the inlet port 70 by a spring 80 connected to an adjustment screw 81 in the housing 60 so that the force of the spring 80 urging the body 61 toward the port 70 can be changed as required. Thus, when the pressure in the subchamber 42 is sufficiently below boiler pressure, it will be seen that the force of the working fluid from the boiler on the lower face 76 of the valve body 61 overcomes the force of the spring 80 on the body 61 and causes the body 61 to move upwardly toward the outlet opening 71 to raise the body 61 from the lower valve seat 66 and allow the working fluid from the boiler to pass through the passage 79 and into the subchamber 42.

It will be seen that a pressure drop is generated in the flow of the working fluid from the boiler through the passage 79. This causes less downward pressure to be exerted on the upper face 78 of the body 61 than on the lower face 76. Frictional drag on the side of the body 61 also produces an upward force on the body 61. As the velocity of the working fluid from the boiler through the passage 79 increases, this pressure differential between the faces 76 and 78 increases along with the frictional drag on the side of body 61 until the downward force exerted by the spring 80 is overcome and the valve body 61 is forced up against the valve seat 69 to stop the flow of the working fluid from the boiler 12 into the working subchamber 42. It will thus be seen that, by appropriately adjusting the adjusting screw 81, the velocity at which the valve body 61 will be forced up against the valve seat 69 can be controlled. The critical velocity of the working fluid from the boiler 12 through the passage 79 at which the valve body 61 closes against seat 69 is controlled so that the kinetic energy induced into the piston 40 by the working fluid from the boiler 12 at the point of boiler valve closure can be selected.

On the other hand, it will be seen that when the pressure in the working subchamber 42 is raised to the vicinity of the pressure of the working fluid in the boiler on the return compression stroke of the piston 40, the pressure on the upper face 78 of the valve body 61 will be raised to a level, in combination with the force of the spring 80, to return the valve body 61 to its lower position, close the body 61 against the valve seat 66 and prevent the working fluid in the working subchamber 42 from being forced back into the boiler 12. This action serves to reset the valve $V_1$ so that when the pressure in the working subchamber 42 drops to boiler pressure, the valve $V_1$ can again open to introduce working fluid into the subchamber 42. To ensure that the valve body 61 will be forced back toward the valve seat 66, a push rod 82 may be provided on the upper face 78 of the valve body 61 to project into the working chamber 42 when the valve body 61 is in its uppermost position. Rod 82 is arranged so that the piston 40 will strike the push rod 82 to force the valve body 61 physically downwardly toward the valve seat 66 to reset the boiler valve $V_1$.

Figure 3:
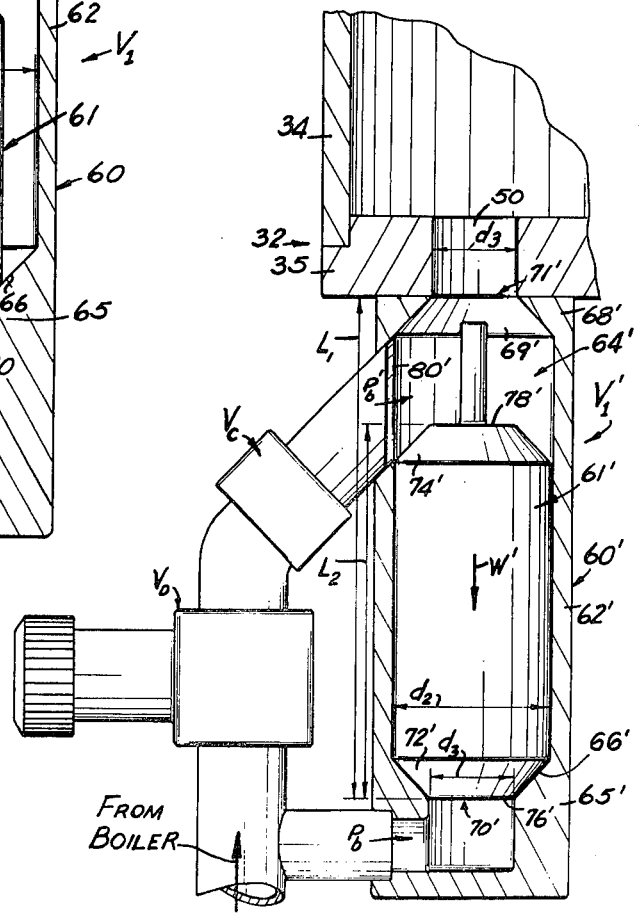
FIG. 3 is an enlarged cross-sectional view of another embodiment of the boiler of the invention.

Referring to FIG. 3, a modified construction of the boiler valve is illustrated in detail, and is designated $V_1'$. The valve $V_1'$ differs from the valve $V_1$ in that the valve $V_1'$ is used in conjunction with an adjustable valve $V_D$ which generates a positive pressure drop thereacross in response to the velocity of the fluid flowing therethrough to activate the valve body 61' in the valve $V_1'$ rather than using the pressure drop in the fluid flowing around the valve body 61 in the valve $V_1$. The common characteristic of both of these valves $V_1'$ and $V_1$ is that they are actuated in response to the velocity of the fluid flowing from the boiler 12 into the working subchamber 42.

The boiler valve $V_1'$ includes a tubular housing 60' which mounts a valve body 61' therein for movement between an upward position blocking the flow of boiler fluid into the subchamber 42 to a lower position which, in conjunction with check valve $V_C$, blocks the flow of working fluid from the subchamber 42 to the boiler. The housing 60' has a cylindrical side wall 62' defining a valve chamber 64' therein of a diameter $d_2$ with a lower inwardly tapering section 65' forming a valve seat 66' on the inside thereof and an upper inwardly tapering section 68' forming a valve seat 69' on the inside thereof. The valve seat 66' defines an inlet opening 70' therethrough of a diameter $d_3$ and the upper valve seat 69' also defines an outlet opening 71' therethrough of the diameter $d_3$.

The valve body 61' is cylindrical with a diameter substantially equal to the diameter $d_2$ so that the valve body 61' is just slidably receivable in the valve chamber 64'. The body 61' has a lower inwardly tapering seating surface 72' adapted to seat on the lower valve seat 66' in sealing relationship therewith when the body moves downwardly in the housing 60' and the upper end of the valve body 61' has an inwardly tapering seating surface 74' adapted to engage the upper valve seat 69' in sealing engagement therewith when the body 61' moves upwardly in the housing 60'. It will be noted that the valve chamber 64' has a length $L_1$ greater than the length $L_2$ between the lower face 76' of the body 61' and the upper face 78' of the body 61'.

It will further be noted that the housing 60' defines an inlet port 80' to the chamber 64' that lies above the valve body 61' when it is in its lowermost position shown in FIG. 3 seated on the lower valve seat 66'. The port 80' is connected to the downstream outlet of the pressure drop valve $V_D$ which has its upstream inlet connected to the outlet of the boiler 12. It will also be noted that the inlet opening 70' below the valve body 61' is connected to the outlet of the boiler 12 upstream of the valve $V_D$. The valve $V_D$ is adjustable and is of the type that generates a pressure drop thereacross that increases with the velocity of the fluid flowing therethrough. Thus, it will be seen that the boiler pressure $P_b$ will be applied to the inlet side of the valve $V_D$ while the pressure $P_b'$ on the outlet side of the valve $V_D$ will be lower than the boiler pressure $P_b$ and will vary according to the velocity of the fluid flowing from the boiler 12 through the valve $V_D$ into the working subchamber 42.

Because the valve body 61' has a prescribed weight W', the valve $V_D$ can be set so that the pressure $P_b$ from the boiler applied to the face 76' of the valve body 61' will be sufficiently greater than the reduced pressure $P_b'$ applied to the upper face 78' of the valve body 61' to cause the valve body 61' to shift upwardly against the upper valve seat 69' and stop the flow of fluid into the working subchamber 42 through the valve $V_1'$ and the inlet port 50. Thus, it will be seen that the net result of the valve $V_1'$ is the same as that of the valve $V_1$. Because the valve body 61' is relatively lightweight, it will require a small pressure drop across the valve $V_D$ to activate the valve $V_1'$. It will be seen that when the downward force exerted on the valve body 61' by the pressure in the working subchamber 42 when the valve body 61' is in its upper position, plus the force generated by the weight W' of the valve body 61', becomes greater than the upward force exerted on the valve body 61' by the pressure at the lower face 76, the valve body 61' will drop to its lowermost position as seen in FIG. 3 to allow the fluid from the boiler 12 to again enter the working subchamber 42 when the pressure in the working subchamber 42 is below the boiler pressure $P_b$. An appropriate check valve $V_C$ may be placed in the line between the inlet port 80' and the boiler 12 to prevent the working fluid in the working subchamber 42 from being forced back into the boiler 12 when the pressure in the subchamber 42 is above boiler pressure $P_b$.

CONDENSER VALVES

Figure 4:
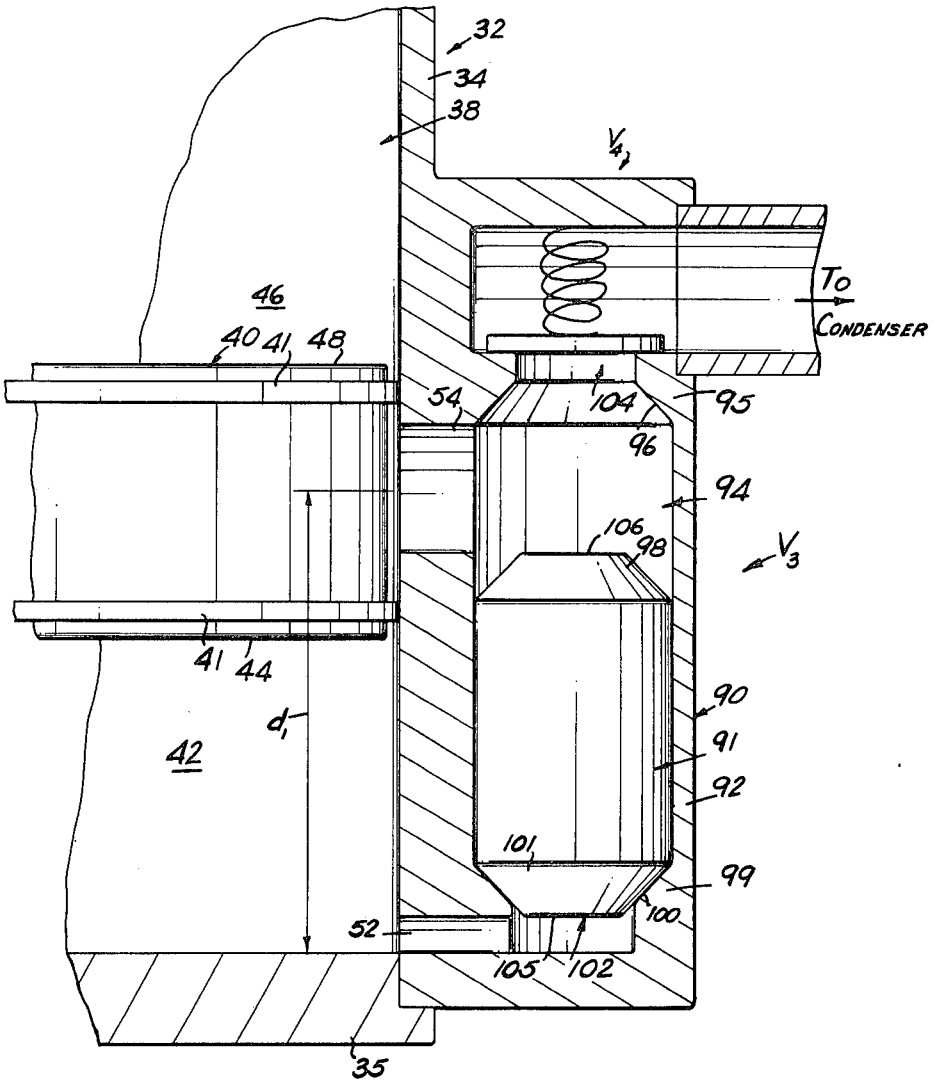
FIG. 4 is an enlarged cross-sectional view of one embodiment of the condenser valves of the invention.

The condenser control valve $V_3$ and the condenser check valve $V_4$ are best seen in FIG. 4 and serve to prevent the discharge of the working fluid from the working subchamber 42 into the condenser 15 during the movement of the free piston assembly 40 toward the back-up subchamber 46 in the up stroke yet allows the discharge of the working fluid from the working subchamber 42 into the inlet 19 of the condenser 15 while the free piston 40 moves toward the working subchamber 42 in the down stroke. The condenser control valve $V_3$ includes a cylindrical housing 90 which slidably mounts a valve body 91 therein. The housing 90 has a cylindrical wall section 92 defining a chamber 94 therein which slidably receives the valve body 91 therein. The upper end of the housing 90 is provided with an inwardly tapering section 95 to form an upper valve seat 96 thereon against which the seating surface 98 on the upper end of the valve body 91 seats as the valve body 91 moves upwardly while the lower end of the housing 90 defines an inwardly tapering section 99 thereon which forms a lower valve seat 100 against which a lower seating surface 101 on the valve body 91 seats as the valve body 91 moves downwardly in the housing 90. It will be seen that the seat 100 defines an opening 102 therethrough in communication with the actuation port 52 in the side wall 34 of the cylinder 32 and the upper valve seat 96 defines an outlet opening 104 therethrough in communication with the condenser outlet port 54. The opening 104 is also connected to inlet 19 of condenser 15 in series with the condenser check valve $V_4$. Valve $V_4$ allows working fluid to flow to the inlet 19 of condenser 15 from the chamber 42 but prevents the flow of the working fluid from the condenser 15 to the chamber 42. The chamber 94 in the housing 90 communicates with the port 54 in the side wall 34 of the cylinder 32 so that when the valve body 91 is in its lower position as seen in FIG. 4, the working subchamber 42 is in communication with the opening 104 through the upper valve seat 96.

The valve body 91 is generally cylindrical with the seating surface 98 at its upper end and the seating surface 101 at its lower end, and has a lower face 105 and an upper face 106. Because the outlet port 54 is located the prescribed distance $d_1$ above the end wall 35 and because the piston 40 blocks port 54 causing the pressure in the working subchamber 42 to rise above condenser pressure as the piston 40 reaches the end of its down stroke and this increase in the pressure of the working fluid in the subchamber 42 causes the pressure exerted on the lower face 105 of the valve body 91 to force the valve body 91 upwardly against the valve seat 96 to prevent the working fluid in the subchamber 42 from entering the condenser 15 when the piston 40 moves from over the port 54 while the piston 40 accelerates upwardly toward the back-up subchamber 46 in the power stroke. The valve body 91 is maintained in its up position while boiler working fluid is introduced into subchamber 42 and until the pressure within the working subchamber 42 again drops below the condenser pressure so that the force exerted on the upper face 106 by the working fluid at condenser pressure exceeds the force exerted on the lower face 105 by the working fluid in chamber 42 to drive the valve body 91 downwardly against the lower valve seat 100. The check valve $V_4$, however, prevents the working fluid from the condenser 15 entering the working subchamber 42 until the pressure in the working subchamber 42 rises back to condenser pressure on the down stroke of piston 40. An external force such as a spring may also be used to aid the piston body 91 in its downward movement.

As the motion of the piston 40 is reversed and moves back down toward the working chamber 42 in the compression stroke, the port 54, which is now in communication with the opening 104, allows the working fluid in the working subchamber 42 to be forced out through the check valve $V_4$ when the pressure in the working subchamber 42 rises to the pressure of the working fluid in the condenser 15. This allows the working fluid in the working subchamber 42 to remain at condenser pressure and the working fluid to be forced from the working subchamber 42 into condenser 15 as the piston continues to move toward the working subchamber 42 until the piston 40 moves over the port 54 to again block the flow of working fluid from the working subchamber 42 through the port 54. This causes the pressure to rise in the working subchamber 42 and this rise in pressure, which is communicated to the lower face 105 of the valve body 91 through the actuation port 52, causes the valve body 91 to be forced back up against the valve seat 96 to prevent the flow of working fluid from the working subchamber 42 until the pressure in the working subchamber 42 has again dropped below the pressure of the working fluid in the condenser 15 during the up stroke.

OPERATION OF THE FIRST EMBODIMENT

It is to be understood that any number of working fluids may be used in this system such as the commercially available refrigerants sold under the trademark "Freon" by E. I. duPont de Nemours Co. The working fluid in the boiler 12 will have some prescribed pressure $P_b$ and some prescribed temperature $T_b$, the condenser 15 will have some prescribed pressure $P_c$ and some prescribed temperature $T_c$, and the evaporator 14 will have some prescribed pressure $P_e$ and some prescribed temperature $T_e$. These pressures and temperatures may vary over the operating range of the system 10, however, it will be noted that, in the absence of friction and heat transfer within the expansion-compression device 11, the system will operate as long as the boiler pressure $P_b$ is greater than the condenser pressure $P_c$. It will further be noted that the pressure in the back-up subchamber must be less than boiler pressure when the free piston 40 is at the limit of its movement toward the working subchamber 42 at the end of the compression stroke and must be greater than the evaporator pressure $P_e$ when the free piston 40 is at the limit of its movemnt toward the back-up subchamber 46 at the end of the power stroke as will become more apparent.

The operation of the system can best be understood by assuming some set values for the pressures and temperatures involved as might be typical for a system in actual operation. For instance, using refrigerant R-12, a boiler temperature $T_b$ of 150° F., an evaporator temperature $T_e$ of 40° F. and a condenser temperature $T_c$ of 95° F., the boiler pressure $P_b$ would be approximately 249 psia, the evaporator pressure $P_e$ would be approximately 52 psia and the condenser pressure $P_c$ would be approximately 123 psia. While it is not necessary that the back-up subchamber 46 be connected to the condenser 15 as long as the pressure within the back-up subchamber 46 is maintained within the parameters set forth above, the system will be described as in direct connection with the inlet to the condenser 15 for sake of simplicity since this pressure is within the parameters set forth, since the connection is convenient, and since this connection produces a sealed system. Further, for sake of simplicity, pressure losses through the various pipes connecting the components of the system and the valves, heat losses and the force of gravity on the piston 40 have been neglected even though these factors may play a role in the practical operation of the system. The initial acceleration of the piston 40 can be calculated by multiplying the force of gravity times the difference between the boiler pressure $P_b$ and the condenser pressure $P_c$ divided by the unit weight of the piston. In the embodiment illustrated, a change in the weight of the piston while the remaining system is not changed would change the volume of working fluid compressed and the length of the stroke.

Initially, the piston 40 is at rest at the bottom of the chamber 38 at position $P_0$. A start valve $V_s$ as shown in FIG. 1 may be placed between the boiler valve $V_1$ and the outlet 16 to the boiler 12. The start valve $V_S$ should be of the fast acting type to allow the flow of boiler working fluid through the boiler valve $V_1$ to achieve the necessary velocity to operate the valve $V_1$. The operation of the system will also become more apparent upon reference to FIGS. 5 and 6. FIG. 5 is a graph plotting the pressure of the working fluid in subchamber 42 versus piston displacement while FIG. 6 is a graph plotting piston velocity versus piston displacement. In each of these figures the up stroke is shown by a solid line while the down stroke is shown by a dashed line. The movement and velocity of the piston between position $P_0$ and $P_1$ during start up is shown by phantom lines.

When the start valve $V_S$ is opened, the boiler valve $V_1$ will introduce the working fluid from the boiler 12 into the working subchamber 42 at boiler pressure $P_b$. This starts accelerating the piston 40 upwardly from position $P_0$ toward the back-up subchamber 46 in the up stroke since the net force on piston 40 is toward subchamber 46. When the piston 40 has reached a prescribed velocity so that the flow of the working fluid from the boiler 12 through the passage 79 about the valve body 61 reaches the critical velocity, the valve body 61 will be shifted to close against the seat 69 and prevent further access of the working fluid from the boiler 12 to the working subchamber 42. This occurs at position $P_1$. Because the boiler pressure $P_b$ is well above the condenser pressure $P_c$, the piston 40 continues to accelerate under the influence of the expanding working fluid initially from the boiler 12.

By the time the piston 40 reaches the position $P_2$ illustrated in FIG. 1, the pressure of the working fluid in the subchamber 42 will be expanded down to the condenser pressure $P_c$. As seen in FIG. 6, the piston 40 has reached peak velocity and thus peak linear kinetic energy at position $P_2$. At position $P_2$ the pressure in back-up subchamber 46 equals the pressure in working subchamber 42 and no net force is applied to piston 40 by the working fluid. The linear kinetic energy which has been induced into piston 40, however, continues to move piston 40 upwardly past position $P_2$.

The pressure in the working subchamber 42 now starts to drop below the condenser pressure $P_c$ so that the net force on the free piston 40 by the working fluid reverses to a downward force. This causes the free piston 40 to start to decelerate as seen in FIG. 6. When the piston 40 reaches position $P_3$, the pressure of the working fluid in the subchamber 42 has expanded to a pressure slightly less than the evaporator pressure $P_e$. This causes the evaporator check valve $V_2$ to open and maintain the pressure in the working subchamber 42 at evaporator pressure $P_e$ while the linear kinetic energy in the piston 40 continues to move the piston past position $P_3$. The linear kinetic energy in piston 40 continues to move the piston 40 toward the back-up subchamber 46 while drawing working fluid from evaporator 14 into the working subchamber 42 until the linear kinetic energy has been consumed as work of compression. Work of compression as used herein includes both the energy required to raise pressure in a working fluid and the energy required to flow the working fluid under a prescribed pressure. The linear kinetic energy in piston 40 will be transferred back into the working fluid of the system by the time the piston 40 reaches position $P_4$ and the piston stops to complete its up stroke.

When the piston 40 stops at position $P_4$, the pressure $P_c$ of the working fluid in the back-up subchamber 46 is greater than the pressure $P_e$ in the working subchamber 42. This pressure difference generates a net force on piston 40 toward the working subchamber 42 to start accelerating the piston 40 toward subchamber 42 in the down stroke. As soon as the down stroke starts the evaporator check valve $V_2$ closes to trap the working fluid drawn into the working subchamber 42 from evaporator 14 in the subchamber 42. Because the boiler valve $V_1$ is closed and since the condenser check valve $V_4$ prevents the flow of working fluid from condenser 15 into subchamber 42 even though control valve $V_3$ has opened, the continued movement of piston 40 toward the subchamber 42 causes the pressure of the working fluid in subchamber 42 to rise. By the time the piston 40 reaches the position $P_5$ in the compression stroke, the pressure in the working subchamber 42 has risen to the condenser pressure $P_c$ and a predetermined linear kinetic energy has been induced into the piston. Because the valve body 91 in the condenser control valve $V_3$ has already dropped to open the opening 104 when the pressure in the working subchamber 42 was lowered below the condenser pressure $P_c$ in the up stroke, the condenser check valve $V_4$ opens to allow the pressure within the working subchamber 42 to remain at condenser pressure and the working fluid in the working subchamber 42 to be expelled into the inlet 19 of the condenser 15 until the piston 40 reaches the position $P_6$ whereupon the piston 40 covers the outlet port 54. Because the pressure forces on the piston 40 have remained equal on both sides thereof during the movement of the piston 40 between positions $P_5$ and $P_6$, it will be seen that the piston remains at substantially the same velocity and thus the linear kinetic energy at position $P_5$ is still maintained at position $P_6$. As soon as the piston 40 covers the outlet port 54, the pressure within the working subchamber 42 starts to rise above condenser pressure $P_c$ as the linear kinetic energy in the piston 40 continues to move the piston toward the working subchamber 42. This raises the pressure in the working subchamber 42 above condenser pressure $P_c$ and this pressure differential across the piston 40 causes the piston to start to slow down as seen in FIG. 6 until the pressure in the working subchamber 42 has reached a certain rebound pressure $P_r$ when the piston reaches position $P_7$. This rebound pressure $P_r$ is sufficiently high to arrest the movement of the piston 40 so that the piston stops at point $P_7$. The linear kinetic energy of the piston 40 at position $P_6$ is thus converted to potential energy in the working fluid in the working chamber 42 and, after the piston 40 has stopped to complete the down stroke, this rebound pressure $P_r$ causes the piston 40 to rebound toward the back-up subchamber 46 and start the next up stroke. Usually, this rebound pressure $P_r$ will be greater than the boiler pressure $P_b$ so that the valve body 61 in the boiler valve $V_1$ has been driven downwardly away from the seat 69. It will also be noted that when the pressure in the working subchamber 42 has risen above the condenser pressure $P_c$, the force on the bottom face 105 of the valve body 91 in the condenser valve $V_3$ has forced the valve body 91 upwardly against the seat 96 to prevent the flow of working fluid from the working subchamber 42 into the condenser 15 until the pressure in the working subchamber 42 again drops below condenser pressure to allow the valve body 91 to drop back against the seat 100. As soon as the pressure in the working subchamber 42 drops sufficiently below the boiler pressure $P_b$ due to the piston 40 moving toward the back-up subchamber 46, to overcome the downward force of the spring 80 on valve body 61, the body 61 in the valve $V_1$ rises to again introduce working fluid under boiler pressure into the subchamber 42 to again accelerate the piston 40 toward the back-up chamber 46 in the up stroke. Thus, it will be seen that the cycle is repeated.

From the foregoing, it will be seen that the working subchamber 42 is used both for expansion and compression. During the time the piston 40 moves from position $P_0$ or $P_7$ to position $P_3$ in its up stroke, the working subchamber 42 is acting as an expander in its expansion stroke. As the piston 40 moves from position $P_3$ to position $P_4$ in its up stroke, the working subchamber 42 is acting as a compressor in its intake stroke. On the other hand, when the piston 40 moves from position $P_4$ to position $P_6$ in its down stroke, the working subchamber 42 acts to compress and expel both the working fluid received from the evaporator and the working fluid delivered by the boiler. By using a single subchamber as both an expander and compressor, the system has the capability of operating over an infinitely variable ratio between boiler pressure $P_b$ and condenser pressure $P_c$ not found in prior art systems.

Also, by blocking the expulsion of the working fluid from subchamber 42 as the piston 40 moves from position $P_6$ to position $P_7$ in its down stroke, the pressure in the subchamber 42 is raised back to or greater than boiler pressure so that no throttling losses are encountered when the boiler valve $V_1$ opens to indroduce working fluid from boiler 12 into the subchamber 42 when subchamber 42 is at boiler pressure. Thus, the requirement of prior art systems that the volume of the subchamber be reduced as close as possible to zero at the end of the compression stroke is eliminated by the system disclosed herein.

We claim:

1. A flow control valve for controlling the flow of a working fluid therethrough from a pressurized source of fluid at a prescribed source pressure comprising:

a housing defining a valve chamber therein having opposed ends, an outlet port from one end of said valve chamber, an inlet port to said valve chamber adjacent said outlet port and an actuation port to the other end of said valve chamber;

a valve body having opposed ends movably carried within said valve chamber between a closed position in which said valve body prevents the flow of working fluid from said inlet port out through said outlet port, and an open position in which said valve body permits the flow of working fluid from said inlet port out through said outlet port, said valve body defining a first working face on one end thereof and a second working face on the opposite end thereof, said second working face continuously exposed to the pressure of the working fluid at said actuation port in both said open and closed positions, and said first working face exposed only to the pressure of the working fluid downstream of said outlet port when said valve body is in said closed position and exposed to the pressure of the working fluid at said inlet port when said valve body is in said open position; and valve control means for selectively moving said valve body from said open position to said closed position, said control means continuously maintaining the pressure of the working fluid at said actuation port substantially at the prescribed source pressure and reducing pressure of the working fluid at said inlet port below the prescribed source pressure proportionally to the velocity of the working fluid flowing through said inlet port so that movement of said valve body from said open position is responsive only to a prescribed pressure differential between said inlet port and said actuation port generated by the velocity of the working fluid flowing through said inlet port and out through said outlet port and movement of said valve body from said closed position to said open position is responsive only to a prescribed pressure differential between the working fluid downstream of said outlet port and said actuation port independently of the pressure at said inlet port.

2. The flow control valve of claim 1 wherein said valve control means includes an actuation valve connecting said source of working fluid to said inlet port, said actuation valve having a valve inlet connected to the pressurized source of fluid and a valve outlet connected to said inlet port, said actuation valve constructed and arranged to generate a pressure drop thereacross in response to the velocity of the working fluid flowing therethrough so that the pressure of the working fluid at said inlet port is reduced below the prescribed source pressure proportionally to the velocity of the working fluid flowing to said inlet port through said actuation valve, said actuation valve including valve adjustment means for selectively changing the amount of pressure drop across said actuation valve while maintaining the pressure drop proportional to the velocity of the working fluid flowing through said actuation valve to selectively change the velocity of the working fluid flowing from said inlet port out through said outlet port at which said valve body moves from said open position to said closed position.

3. The flow control valve of claim 2 further including check valve means connecting said valve outlet of said actuation valve with said inlet port and permitting flow of working fluid only from said actuation valve to said inlet port.

4. The flow control valve of claim 3 wherein said housing and said valve body are oriented so that the weight of said valve body urges said valve body toward said open position.

5. A flow control arrangement for controlling the flow of a working fluid from a pressurized supply of fluid comprising:

a piston housing defining a piston chamber therein;

a piston slidably carried in said piston chamber in sealing engagement with said piston housing forming a working subchamber in said piston chamber which varies in volume as said piston slidably moves along said piston chamber;

a valve housing defining an elongate valve chamber therein having opposed ends, an outlet port connecting one end of said valve chamber to said working subchamber in said piston housing at a location so that said outlet port connects said valve chamber to said working subchamber regardless of the position of said piston in said piston chamber, an inlet port to said valve chamber adjacent said outlet port, and an actuation port to the other end of said valve chamber always in direct connection to the pressurized source of fluid;

a valve body having opposed ends movably carried in said valve chamber for movement of said valve body from a closed position at one end of said valve chamber to an open position at the other end of said valve chamber, said valve body constructed and arranged to close said outlet port in said closed position to prevent working fluid from flowing from said inlet port through said outlet port into said working subchamber and to prevent the pressure of the working fluid at said inlet port from exerting a force on said valve body urging said valve body toward said open position, said valve body defining a first working face on one end thereof in communication only with the working fluid in said working subchamber through said outlet port when said valve body is in said closed position and in communication with the working fluid in said inlet port and the working fluid in said working subchamber through said outlet port when said valve body is in said open position, and said valve body defining a second working face on the opposite end thereof always in communication with the working fluid in said actuation port; and an actuation valve connecting the pressurized source of fluid to said inlet port, said actuation valve constructed and arranged to generate a pressure drop thereacross in response to the velocity of the working fluid flowing therethrough to said inlet port so that when said valve body is in said open position, the working fluid will flow through said actuation valve into said working subchamber through said inlet port, said valve chamber and said outlet port until the velocity of the working fluid through said actuation valve causes the pressure of the working fluid in said working subchamber at said outlet port to drop sufficiently below the pressure of the working fluid directly from the pressurized source of fluid at said actuation port to cause the difference between the pressures of the working fluid on said first and second working faces of said valve body to exert a net force on said valve body sufficient to move said valve body to said closed position preventing the flow of working fluid from the pressurized source of fluid into said working subchamber through said inlet port and said outlet port whereupon the pressure of the working fluid on said second working face of said valve body from the pressurized source of fluid through said actuation port continues to hold said valve body in said closed position until the pressure of the working fluid in said working subchamber acting on said first working face of said valve body increases sufficiently to cause the difference between the pressures of the working fluid on said first and second working faces of said valve body to exert a net force on said valve body sufficient to move said valve body to said open position.

* * * * *